US006761597B2

(12) United States Patent
Shimizu

(10) Patent No.: US 6,761,597 B2
(45) Date of Patent: Jul. 13, 2004

(54) TERMINAL STRUCTURE WITH SPRING-LOADED CONTACT

(75) Inventor: Tomohiko Shimizu, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/214,569

(22) Filed: Aug. 9, 2002

(65) Prior Publication Data

US 2003/0032342 A1 Feb. 13, 2003

(30) Foreign Application Priority Data

Aug. 10, 2001 (JP) ..... 2001-245045

(51) Int. Cl.[7] ..... H01R 11/22; H01R 13/11
(52) U.S. Cl. ..... 439/852; 439/748
(58) Field of Search ..... 439/852, 851, 439/748

(56) References Cited

U.S. PATENT DOCUMENTS 4,950,183 A * 8/1990 Watanabe et al. ..... 439/843
5,593,328 A * 1/1997 Okada et al. ..... 439/851
5,707,259 A * 1/1998 Ishizuka et al. ..... 439/852
5,716,245 A * 2/1998 Kameyama et al. ..... 439/852
6,116,970 A * 9/2000 Yamamoto et al. ..... 439/852
6,478,636 B1 * 11/2002 Makita et al. ..... 439/852

* cited by examiner

*Primary Examiner*—Hae Moon Hyeon
(74) *Attorney, Agent, or Firm*—Finnegan, Henderson, Farabow, Garrett & Dunner, L.L.P.

(57) ABSTRACT

A terminal structure is provided with a bottom wall portion, a replicated portion being extended from the bottom wall portion and folded and an elastic contact portion being extended from the replicated portion. The bottom wall portion, the replicated portion and the elastic contact portion are integrally press-formed from a conductive material sheet having high ductility.

7 Claims, 6 Drawing Sheets

TERMINAL STRUCTURE WITH SPRING-LOADED CONTACT

BACKGROUND OF THE INVENTION

1. Field of the Invention

The present invention relates to a structure of a terminal having a spring-loaded contact which is integrally press-formed from a conductive material sheet.

2. Description of the Related Art

A conventional terminal having a spring-loaded contact is press-formed from a conductive material sheet. The conventional terminal is provided with a bottom wall and a contact. The contact is integrally extended from the bottom wall and plastically replicated. The contact is elastically deformable and press-contacts with an opposite terminal when the opposite terminal is inserted into the conventional terminal.

SUMMARY OF THE INVENTION

The replicated portion of the terminal may have a history of a severe deformation by press-forming. Use of a core bar for the press-forming is necessary to avoid fracture of the replicated portion. The use of the core bar increases production steps and causes a decreasing of productivity of the terminal. Therefore an art of nonuse of the core bar as well as avoiding fracture of the terminal is desired.

The present invention is intended to solve the above problem and a purpose thereof is provision of a structure of a terminal having a spring-loaded contact which is not easy to be fractured in course of production.

According to a first aspect of the present invention, a terminal structure is provided with a bottom wall portion, a replicated portion being extended from the bottom wall portion and folded and an elastic contact portion being extended from the replicated portion. The bottom wall portion, the replicated portion and the elastic contact portion are integrally press-formed from a conductive material sheet having high ductility.

The terminal is made of a highly ductile material so that the replicated portion is not easy to be fractured. Thereby use of the core bar may be omitted and excellent productivity is gained.

According to a second aspect of the present invention, a terminal structure is provided with a bottom wall portion, a replicated portion being extended from the bottom wall portion and folded, an elastic contact portion being extended from the replicated portion and a projection abutting the elastic contact portion. The projection is projected from the bottom wall portion. The bottom wall portion, the replicated portion, the elastic contact portion and the projection are integrally press-formed from a conductive material sheet.

The terminal is provided with a projection abutting the elastic contact portion so that the elastic contact portion is prevented from being excessively bent. Thereby use of the core bar may be omitted and excellent productivity is gained.

Preferably, the projection is formed by indenting the bottom wall portion.

More preferably, the elastic contact portion is provided with a front bevel portion extended from the replicated portion, a rear bevel portion extended from the front bevel portion and a sliding elbow portion extended from the rear bevel portion. The sliding elbow portion slidably contacts the bottom wall portion.

Both the front bevel portion and the rear bevel portion press the elastic contact portion to an opposite terminal when the opposite terminal is inserted into the terminal. Thereby contact of the elastic contact portion with the opposite terminal is further assured.

DETAILED DESCRIPTION OF THE PREFERRED EMBODIMENT

Figure 1:
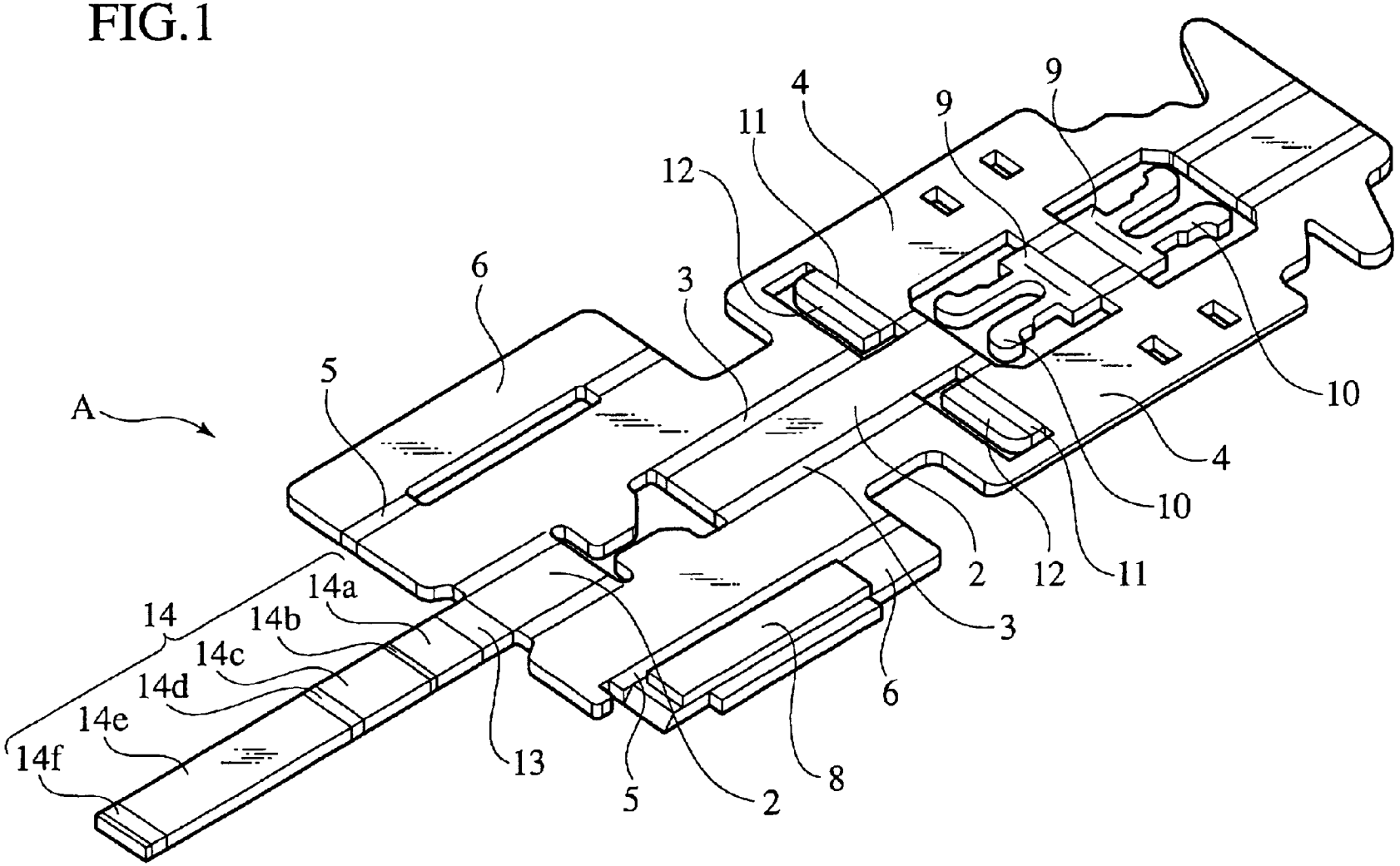
FIG. 1 is a plan view of a terminal before press-forming according to a first embodiment of the present invention.

A first embodiment of the present invention is described hereinafter in reference to FIGS. 1 and 2.

A terminal 1 is made of conductive material which has high ductility so that it is not easy to fracture when being plastically deformed. The terminal 1 is press-formed from a plate A as shown in FIG. 1. Reference numbers of FIG. 1 are related to elements of the terminal 1 after press-forming. A front side of the terminal 1 is shown in the lower left side of FIG. 1 and a rear side is shown in the upper right side. The terminal 1 is mainly provided with a bottom wall portion 2, a pair of sidewall portions 4 connected with both sides of the bottom wall portion 2 via first bend portions 3, a pair of top wall portions 6 respectively connected with the side wall portions 4 via second bend portions 5, a terminal contact portion 8 press-formed on one of the top wall portions 6, two clamp portions 10 connected with the bottom wall portion 2 via third bend portions 9, a pair of partition portions 12 respectively connected with the side wall portions 4 via fourth bend portions 11 and an elastic contact portion 14 connected with a front end of the bottom wall portion 2 via a replicated portion 13.

The elastic contact portion 14 includes, as in order from the replicated portion 13, a linear portion 14*a*, a sixth bend portion 14*b*, a front bevel portion 14*c*, a seventh bend portion 14*d*, a rear bevel portion 14*e* and a sliding elbow portion 14*f*. The bend portions 3, 5, 9, 11, 14*b*, 14*d*, the replicated portion 13 and the sliding elbow portion 14*f* are bend in respectively pre-determined directions and angles by press-forming so that the terminal 1 is formed.

Figure 2:
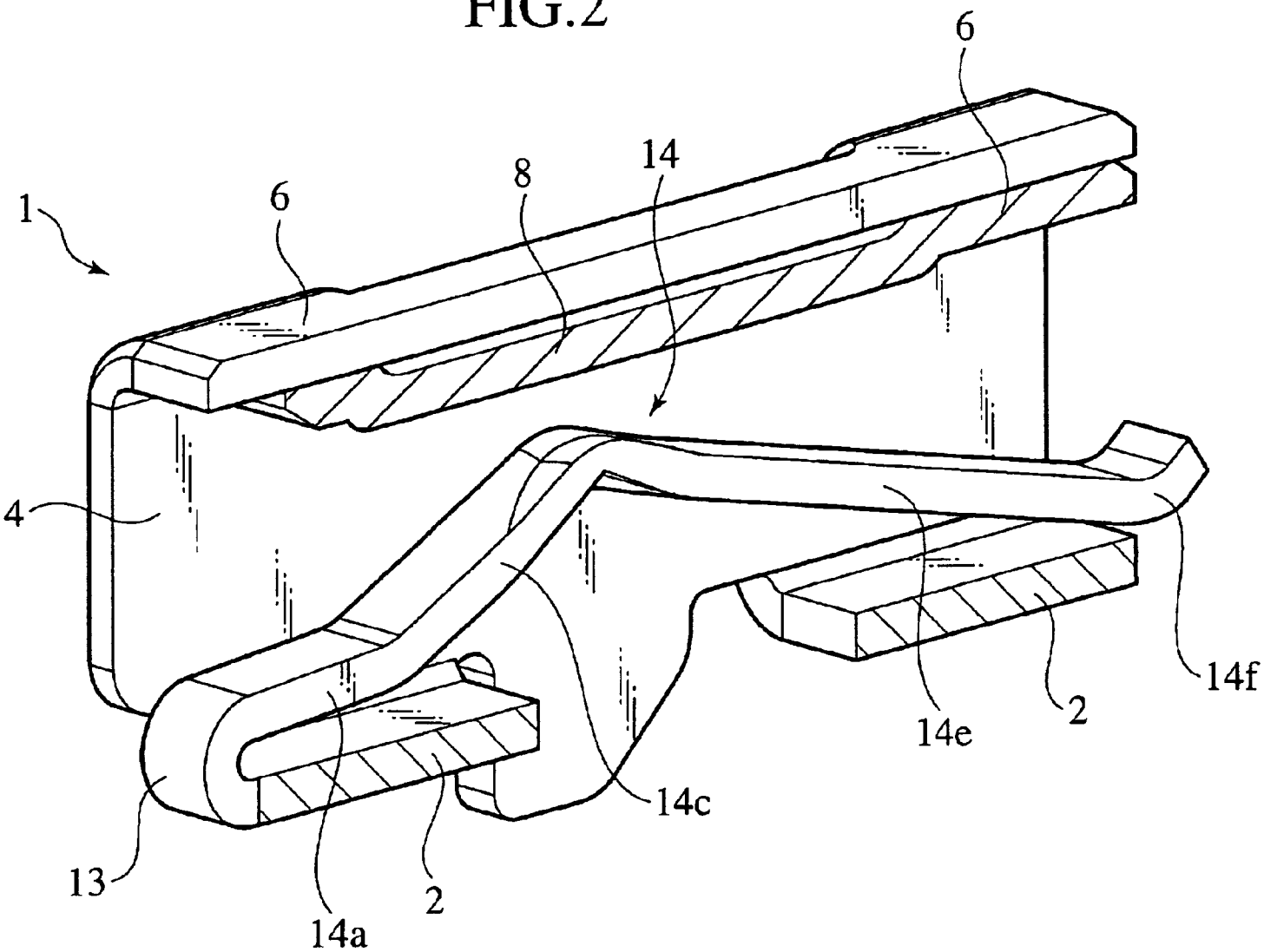
FIG. 2 is a perspective view of the terminal after press-forming according to the first embodiment of the present invention, showing a principal portion thereof.

The elastic contact portion 14 is formed as a structure shown in FIG. 2. The elastic contact portion 14 is replicated at the replicated portion 13 and includes the relatively short linear portion 14*a*. The front bevel portion 14*c* is directed upward from the linear portion 14*a*. The rear bevel portion 14*e* is directed downward from the front bevel portion 14*c*. The sliding elbow portion 14*f* is integrally connected with a rear end of the rear bevel portion 14*e* and slidably contacts the bottom wall portion 2. The elastic contact portion 14 is elastically deformed to receive an opposite terminal when inserted. The elastic contact portion 14 is forced to contact the opposite terminal by its elastic force so that an electric contact thereof is assured.

Figure 3:
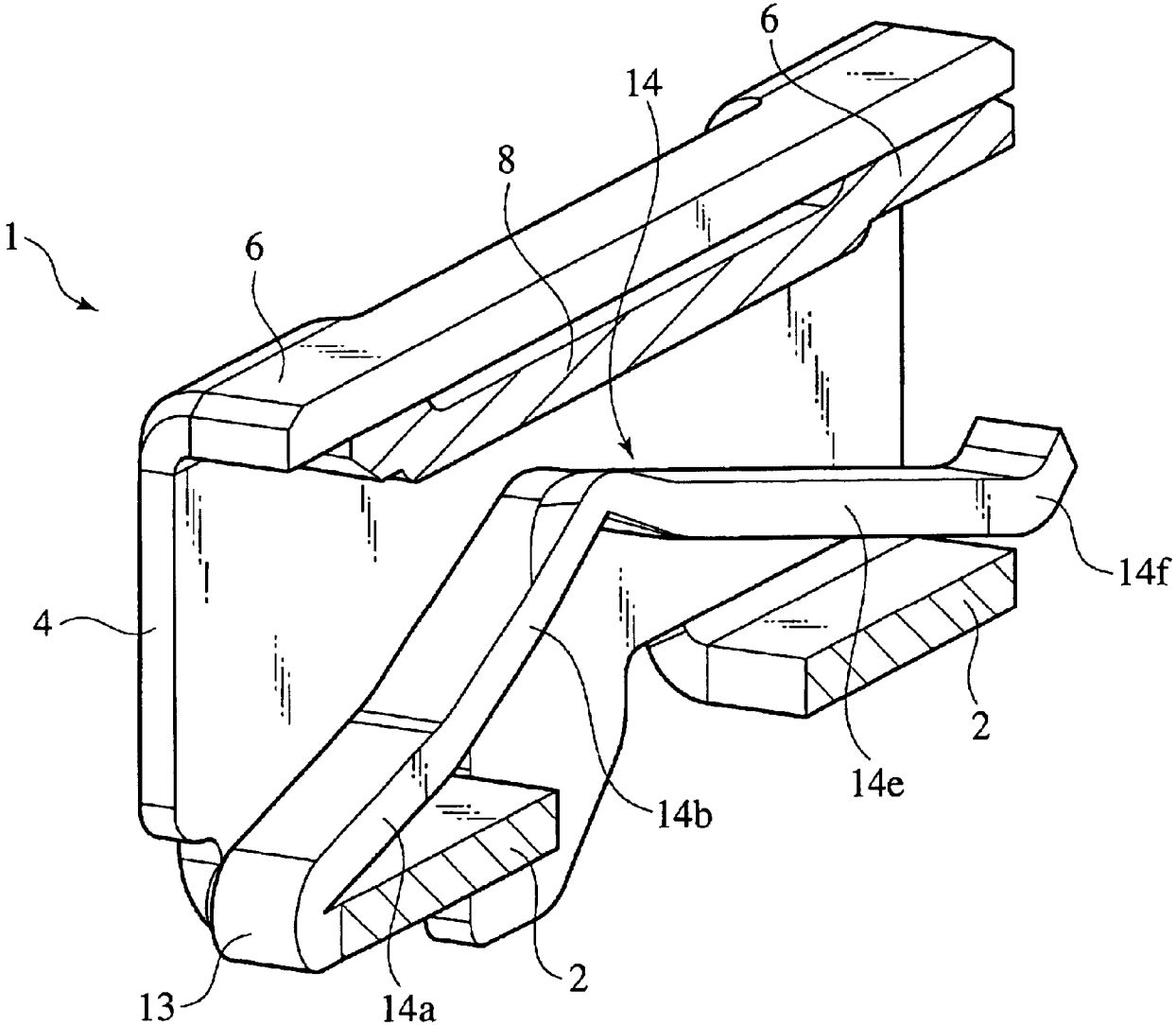
FIG. 3 is a perspective view of the terminal after press-forming according to a first modification of the first embodiment of the present invention, showing a principal portion thereof.
Figure 4:
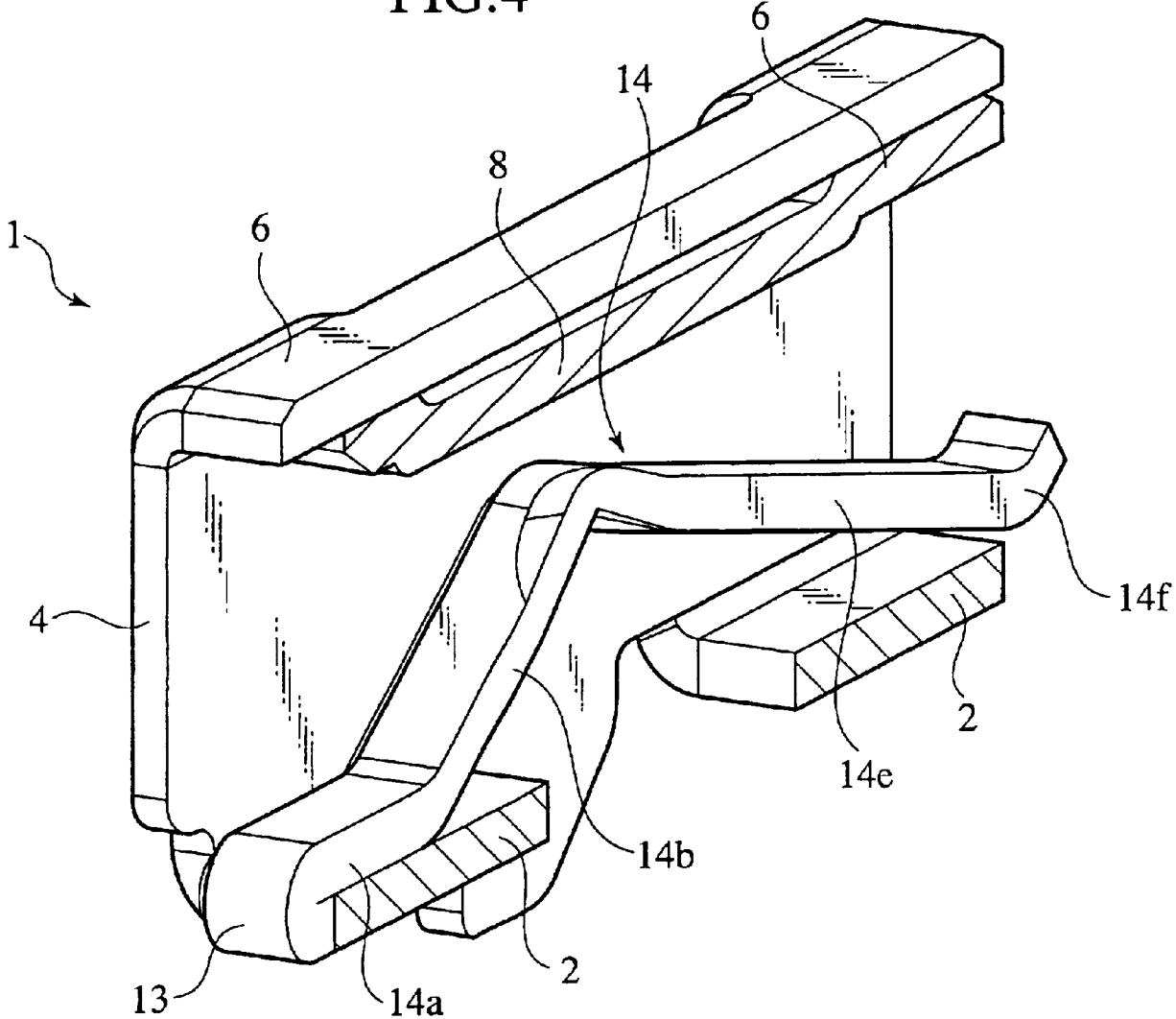
FIG. 4 is a perspective view of the terminal after press-forming according to a second modification of the first embodiment of the present invention, showing a principal portion thereof.

First and second modifications of the first embodiment of the present invention are described hereinafter in reference to FIG. 3 and FIG. 4 respectively.

The replicated portion 13 according to the first modification is folded like a sharp edge and the one of the second modification is folded in closely contact manner. The terminal 1 is made of an highly ductile material so that such excessive plastic deformation is possible without fracture. It is not necessary to use a core bar in forming, therefore it is possible to increase productivity and reduce defective productions. Of course, the first embodiment as shown in FIG. 2 in which the replicated portion 13 is folded in a round shape is more preferable.

Figure 5:
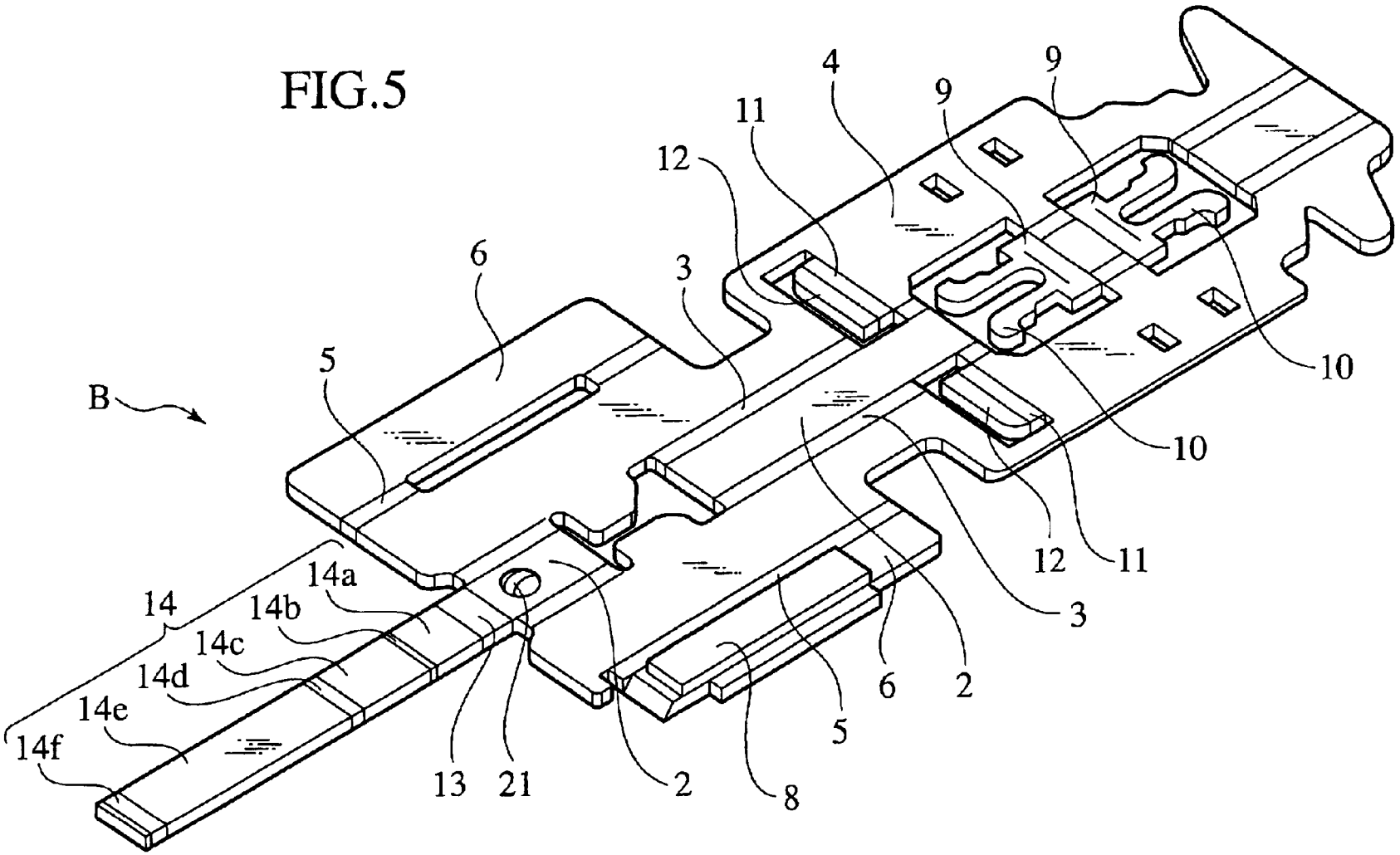
FIG. 5 is a plan view of a terminal before press-forming according to a second embodiment of the present invention.
Figure 6:
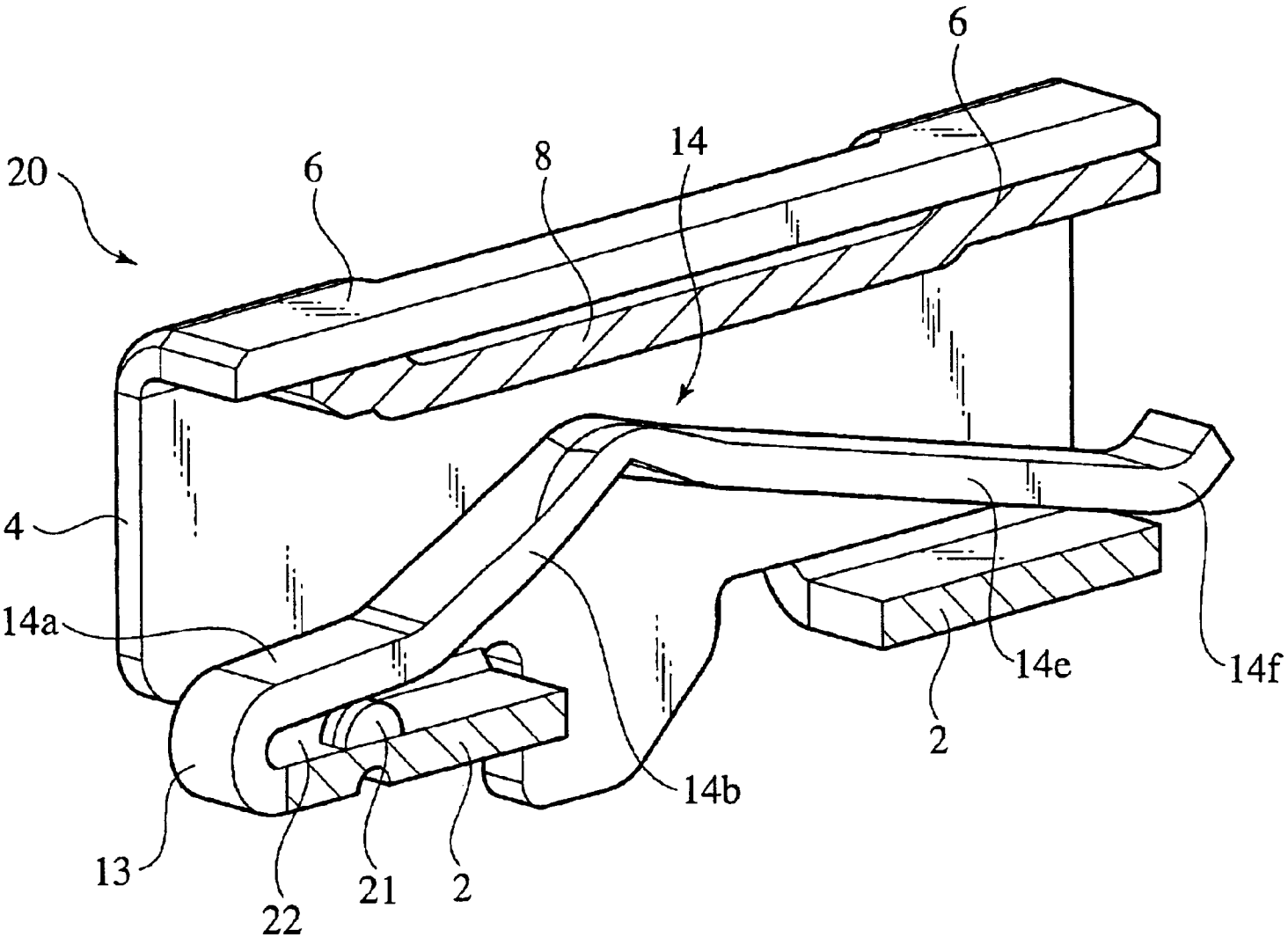
FIG. 6 is a perspective view of the terminal after press-forming according to the second embodiment of the present invention, showing a principal portion thereof.

A second embodiment of the present invention is described hereinafter in reference to FIGS. 5 and 6. In the second embodiment, the same elements as the above first embodiment are referenced with the same numerals and the detailed descriptions are omitted.

A terminal 20 of the second embodiment is made of a low ductile material unlike the first embodiment described above. Though the terminal 20 is also formed by press-forming in a likewise manner as the first embodiment, the terminal 20 further includes an indented portion 21. The indented portion 21 is projected upward so as to prevent the elastic contact portion 14 from excessive deformation. The indented portion 21 is formed by press-forming of a corresponding portion of the bottom wall portion. The bend portions 3, 5, 9, 11, 14*b*, 14*d*, the replicated portion 13 and the sliding elbow portion 14*f* are bend in respectively pre-determined directions and angles by press-forming in a likewise manner as the first embodiment.

The replicated portion 13 is folded to contact the indented portion 21. A space 22 is created between the replicated portion 13 and the bottom wall portion 2.

According to the second embodiment, the indented portion 21 prevents excessive deformation of the replicated portion 13 so that it is not necessary to use a core bar in forming. Therefore it is possible to increase productivity and reduce defective productions in a case where poor ductile material is applied. Furthermore, an electric contact of the elastic contact portion 14 and an opposite terminal is assured in likewise manner as the first embodiment. Of course, high ductile material may be applied to the terminal 20 of the second embodiment so that productivity and reliability thereof is further assured.

Although the invention has been described above by reference to certain embodiments of the invention, the invention is not limited to the embodiments described above. Modifications and variations of the embodiments described above will occur to those skilled in the art, in light of the above teachings.

What is claimed is:

1. A terminal structure integrally press-formed from a conductive sheet of high ductility material so as to allow excessive deformation of a replicated portion without a fracture, the terminal structure comprising:

a bottom wall portion;

the replicated portion being extended from the bottom wall portion and being folded;

an elastic contact portion being extended from the replicated portion; and a projection projected from the bottom wall portion and configured to abut the elastic contact portion so that the replicated portion is prevented from being excessively folded, wherein the elastic contact portion comprises:

a linear portion being substantially parallel to the bottom wall portion and being extended from the replicated portion;

a front bevel portion extending upwardly from the linear portion; and a rear bevel portion extending downwardly from the front bevel portion, wherein the projection projected from the bottom wall portion is configured to abut a portion of the linear portion.

2. The terminal structure of claim 1, wherein the projection is formed by indenting a portion of the bottom wall portion.

3. The terminal structure of claim 1, wherein the elastic contact portion comprises:

a front bevel portion extended from the replicated portion;

a rear bevel portion extended from the front bevel portion; and a sliding elbow portion extended from the rear bevel portion and configured to slidably contact the bottom wall portion.

4. A terminal structure integrally formed from a conductive sheet, comprising:

a bottom wall portion;

a replicated portion being extended from the bottom wall portion and being folded;

an elastic contact portion being extended from the replicated portion, the elastic contact portion comprises:

a linear portion extended from the replicated portion and being substantially parallel to the bottom wall portion;

a front bevel portion extending upwardly from the linear portion; and a rear bevel portion extending downwardly from the front bevel portion; and a projection projected from the bottom wall portion and being configured to abut a portion of the linear portion in the elastic contact portion so that the replicated portion is prevented from being excessively folded.

5. The terminal structure of claim 4, wherein the projection is formed by indenting a portion of the bottom wall portion.

6. The terminal structure of claim 4, wherein the elastic contact portion further comprises a sliding elbow portion extended from the rear bevel portion, the sliding elbow portion being configured to slidably contact the bottom wall portion.

7. The terminal structure of claim 4, wherein the terminal structure is integrally press-formed from a conductive sheet of high ductility material so as to allow excessive deformation of a replicated portion without a fracture.

* * * * *